US007899198B2

(12) United States Patent
Holmi et al.

(10) Patent No.: US 7,899,198 B2
(45) Date of Patent: Mar. 1, 2011

(54) HEADREST SURROUND CHANNEL ELECTROACOUSTICAL TRANSDUCING

(76) Inventors: Douglas J. Holmi, Framingham, MA (US); Michael D. Rosen, Framingham, MA (US)

( * ) Notice: Subject to any disclaimer, the term of this patent is extended or adjusted under 35 U.S.C. 154(b) by 1104 days.

(21) Appl. No.: 11/614,356

(22) Filed: Dec. 21, 2006

(65) Prior Publication Data

US 2007/0092100 A1 Apr. 26, 2007

Related U.S. Application Data

(62) Division of application No. 09/532,907, filed on Mar. 21, 2000, now Pat. No. 7,424,127.

(51) Int. Cl.
*H04R 25/00* (2006.01)

(52) U.S. Cl. ..... 381/302; 381/86; 381/389

(58) Field of Classification Search ..... 381/86, 381/300, 302, 303, 304, 305, 306, 307, 332, 381/333, 386, 387, 388, 389
See application file for complete search history.

(56) References Cited

U.S. PATENT DOCUMENTS

| | | | | |
|---|---|---|---|---|
| 3,976,162 A | | 8/1976 | Cummings | |
| 4,042,791 A | | 8/1977 | Wiseman | |
| 4,210,784 A | | 7/1980 | Phillips | 381/301 |
| 4,594,729 A | * | 6/1986 | Weingartner | 381/18 |
| 4,797,934 A | | 1/1989 | Hufnagel | |
| 4,866,776 A | * | 9/1989 | Kasai et al. | 381/302 |
| 5,031,220 A | | 7/1991 | Takagi et al. | |
| 5,129,004 A | | 7/1992 | Imai et al. | |
| 5,131,051 A | | 7/1992 | Kishinaga et al. | 381/82 |
| 5,146,507 A | | 9/1992 | Satoh et al. | 381/86 |
| 5,251,260 A | | 10/1993 | Gates | |
| 5,742,691 A | | 4/1998 | Ambourn | |
| 5,754,664 A | | 5/1998 | Clark et al. | |
| 5,765,314 A | | 6/1998 | Giglio et al. | |
| 5,883,961 A | | 3/1999 | House et al. | |
| 5,887,071 A | | 3/1999 | House | |
| 6,067,360 A | | 5/2000 | Kasai et al. | |
| 7,424,127 B1 | * | 9/2008 | Holmi et al. | 381/386 |
| 7,561,706 B2 | * | 7/2009 | Holmi et al. | 381/306 |

FOREIGN PATENT DOCUMENTS

| | | |
|---|---|---|
| DE | 4419079 | 11/1995 |
| EP | 0 917 400 | 5/1999 |
| FR | 2 768 100 A | 3/1999 |

(Continued)

OTHER PUBLICATIONS

Examination Report dated Jan. 21, 2009 for EP Application 01 301 570.6-2225.

(Continued)

*Primary Examiner*—Huyen D Le
(74) *Attorney, Agent, or Firm*—Bose Corporation

(57) ABSTRACT

An audio system including a first audio source, including a surround channel signal, coupled to an electroacoustical transducer mounted in the back of a seat of, for example, an automobile, so that the surround channel is radiated from the electroacoustical transducer. In one embodiment, the electroacoustical transducer is oriented to radiate substantially upwardly.

11 Claims, 7 Drawing Sheets

FOREIGN PATENT DOCUMENTS

| | | | |
|---|---|---|---|
| FR | 2 779 313 | A | 3/1999 |
| FR | 2768099 | A | 3/1999 |
| FR | 2 768 099 | A | 12/1999 |
| GB | 2 224 178 | A | 4/1990 |
| GB | 2264613 | A | 9/1993 |
| GB | 2338621 | A | 12/1999 |
| JP | 56-047197 | | 4/1981 |
| JP | 61-127299 | | 6/1986 |
| JP | 61-188243 | | 8/1986 |
| JP | 64-078600 | | 3/1989 |
| JP | 01-136844 | | 5/1989 |
| JP | 01-202100 | | 8/1989 |
| JP | 02-007699 | | 1/1990 |
| JP | 02-113494 | | 9/1990 |
| JP | 03-085095 | | 4/1991 |
| JP | 03-085096 | | 4/1991 |
| JP | 04-137897 | | 5/1992 |
| JP | 04-325338 | | 11/1992 |
| JP | 05-191342 | | 7/1993 |
| JP | 07-264689 | | 10/1995 |
| JP | 07-281975 | | 10/1995 |
| JP | 08-331682 | | 12/1996 |
| JP | 09-070100 | | 3/1997 |
| JP | 09 252 499 | A | 9/1997 |
| JP | 10-194049 | | 7/1998 |
| JP | 11-150799 | | 6/1999 |
| SE | 8204930 | | 4/1986 |
| WO | 93/01951 | | 2/1993 |
| WO | 94/15815 | | 7/1994 |
| WO | 97/16048 | A | 5/1997 |

OTHER PUBLICATIONS

Office Action mailed Oct. 31, 2007 in counterpart European application No. 01 301 570.6 (4 pgs).

Office Action dated May 2, 2008 from Japan Application No. 2001-079765.

Action and Response History for U.S. Appl. No. 09/532,907, through Jun. 18, 2008.

EP Examination dated Apr. 28, 2010 for EP Appln. No. 01301570.6-2225.

* cited by examiner $$L_S' = G(L_S + R_S) + H(L_S - R_S)$$
$$R_S' = G(L_S + R_S) - H(L_S - R_S)$$

HEADREST SURROUND CHANNEL ELECTROACOUSTICAL TRANSDUCING

This application is a divisional and claims the benefit of priority under 35 USC 120 of U.S. application Ser. No. 09/532,907, filed Mar. 21, 2000 now U.S. Pat. No. 7,424,127. The disclosure of the prior application is considered part of and is incorporated by reference in the disclosure of this application.

The invention relates to seat-mounted speakers, and more particularly to surround sound speakers mounted in backs of seats, such as car seats.

It is an important object of the invention to provide improved surround sound to occupants of seats in environments such as car seats.

According to the invention, an audio system includes an audio source having a plurality of audio channel signals including a surround channel signal; a seat having a seat back; an electroacoustical transducer mounted in the seat back; and electronic circuit coupling the audio signal source and the electroacoustical transducer for transmitting the surround channel signal to the electroacoustical transducer.

In another aspect of the invention, a sitting device, includes a back portion having an upper surface; and an electroacoustical transducer, mounted in the upper surface along an axis with the axis oriented substantially upward from the upper surface.

Other features, objects, and advantages will become apparent from the following detailed description, which refers to the following drawings in which.

Figure 1:
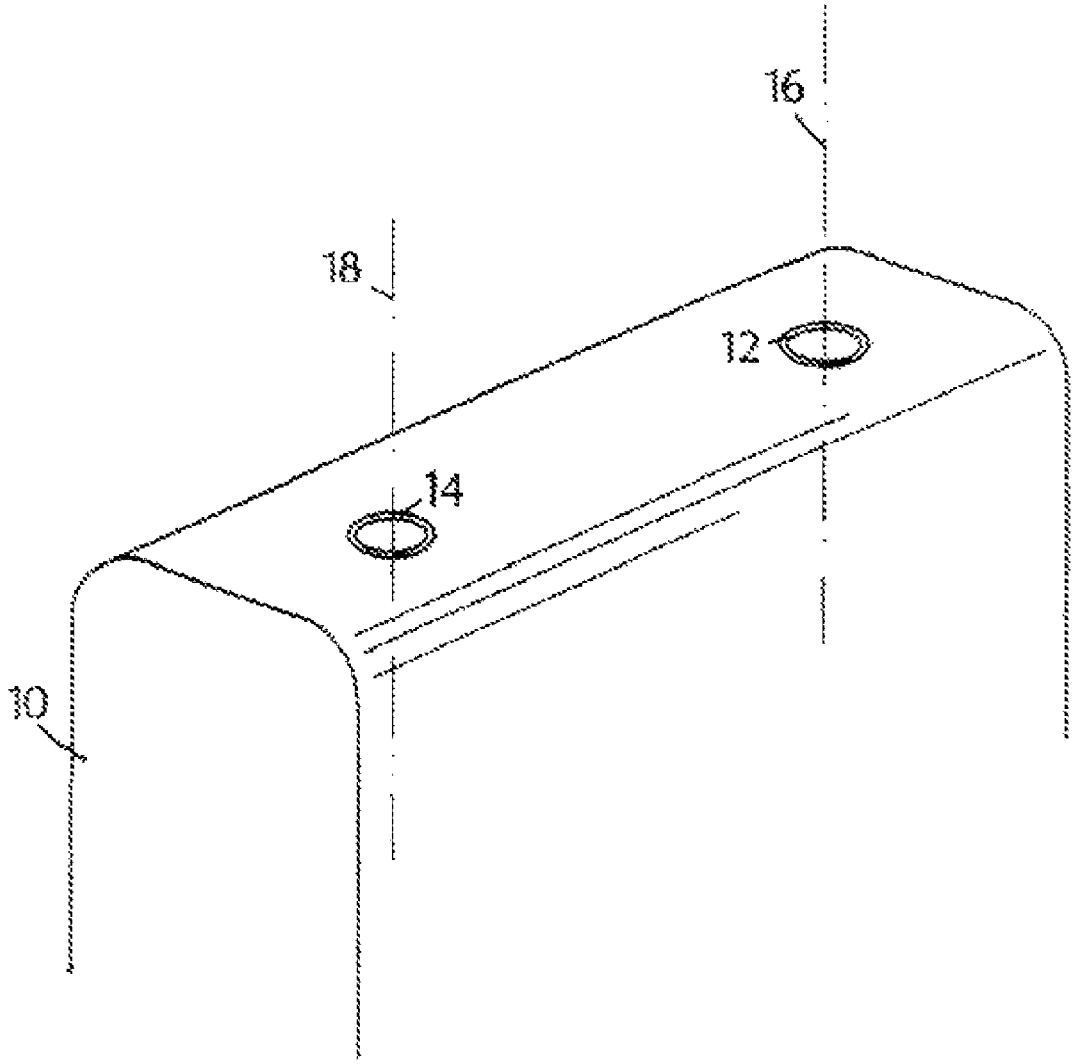
FIG. 1 is an isometric view of a seat back according to the invention.

Referring now to the drawings, and particularly to FIG. 1, there is shown a seating device and acoustic assembly according to the invention. Back of seating device 10 includes two electroacoustical transducers 12, 14 oriented such that their respective axes are substantially vertical. The axis of an electroacoustical transducer, as used herein, refers to the axis of the radiating surface, the upper portion of which, also typically points in the primary direction of radiation, especially at high frequencies. The axis orientation is taken relative to the back of seating device 10, so that if the back of seating device 10 is reclined, the axis retains its orientation relative to the seat back. Electroacoustical transducers 16, 18 receive signals from an audio signal source (not shown) and radiate sound waves representative of the audio signals. Sound waves thus generate can be heard by an occupant of the seating device.

Figure 2:
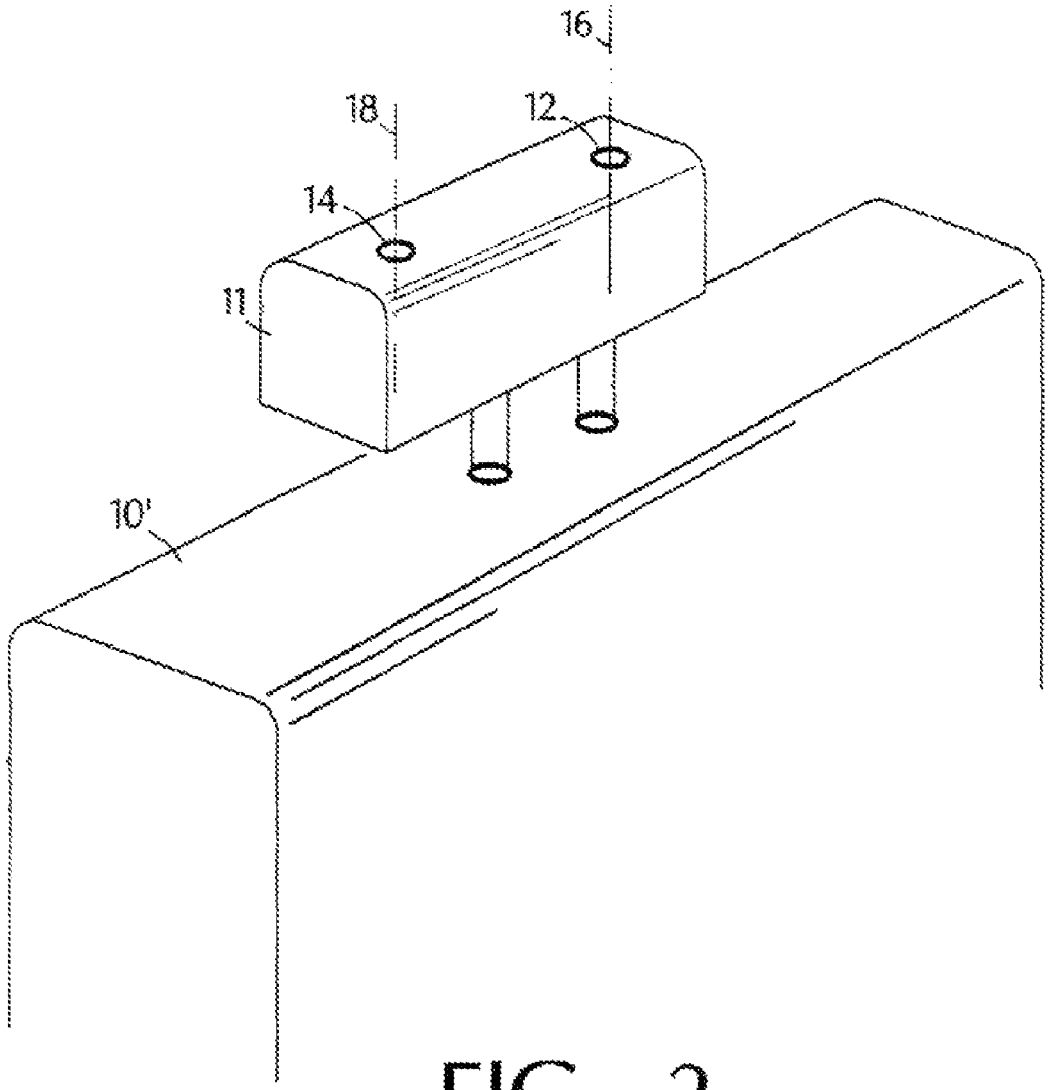
FIG. 2 is an isometric view of a seatback having a headrest, incorporating the invention.

Referring now to FIG. 2, there is shown a second embodiment of the seating device and acoustic assembly of FIG. 1. In FIG. 2, electroacoustical transducers 12, 14 are mounted in a headrest 11 attached to seating device 10'.

Seeing devices 10 and 10' can be any one of a variety of devices. Examples include automotive seats, seats for other vehicles, such as trains or airplanes, theatre or auditorium seats, home furniture chairs or sofas, or other devices designed for seating which have backs. Electroacoustical transducers 12, 14 are situated such that one transducer is on each side of a user's head when the user is seated in the seating device. This transducer placement facilitates using the transducers for directional audio signals, such left and right stereophonic signals.

Figure 3A:
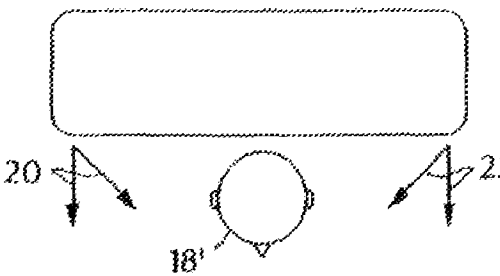
PRIOR ART FIG. 3A
FIGS. 3A-3C are top views of a prior art seat mounted speaker system.
Figure 3B:
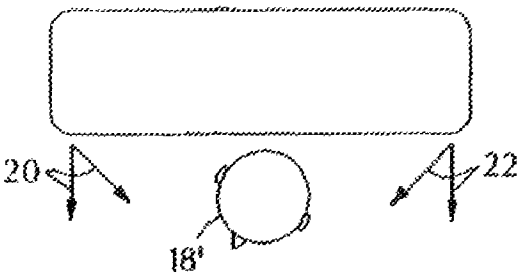
PRIOR ART FIG. 3B
Figure 3C:
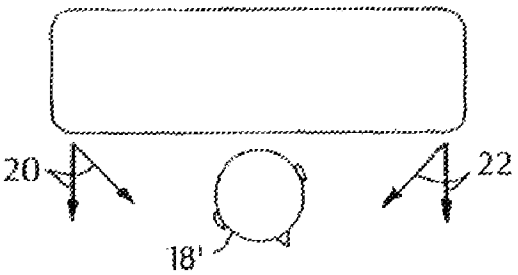
PRIOR ART FIG. 3C

Referring to FIGS. 3A, 3B and 3C, there are shown several top views of conventional seat back or head rest mounted transducers, with a user's head 18' at different orientations relative to the transducers. If the axes 20, 22 of the transducers are oriented predominantly forward or inward as shown, a turning of the user's head causes a shift in the orientation of the user's ears relative to the axes of the speakers. This causes a shift in the left-right balance of the sound, a shift that is especially pronounced at high frequencies (at which the sound waves are more directional than at lower frequencies).

Figure 4A:
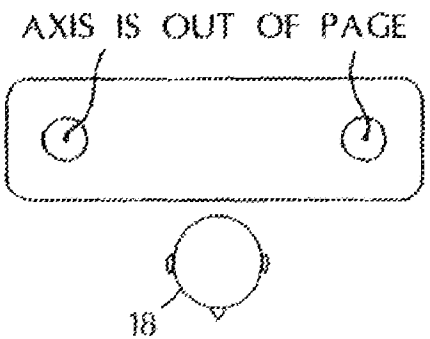
FIGS. 4A-4C are top views of a seat mounted speaker system according to the invention.
Figure 4B:
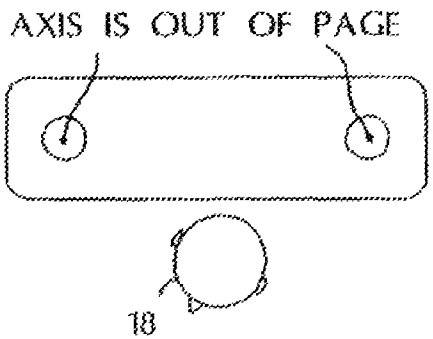
Figure 4C:
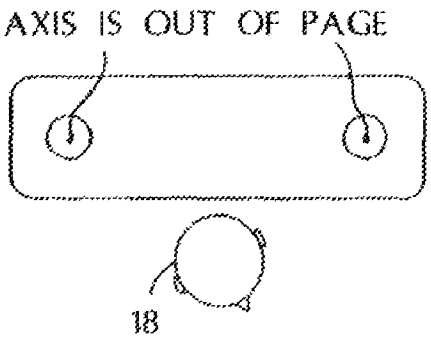

Referring to FIGS. 4A, 4B and 4C there are shown several top views of a seat back or headrest mounted transducers according to the invention, with a user's head 18 at different orientations relative to the transducers. The axes of transducers do not need to be precisely vertical (that is parallel to the axis of rotation of the user's head 18). An orientation that is within ±20 degrees of vertical will give improved performance over the prior art orientation of FIGS. 3A-3C, wherein the transducers are mounted such that their axes are predominantly sideward or forward relative to the seat back or headrest, and predominantly perpendicular to the axis of rotation of the user's head 18.

Figure 5A:
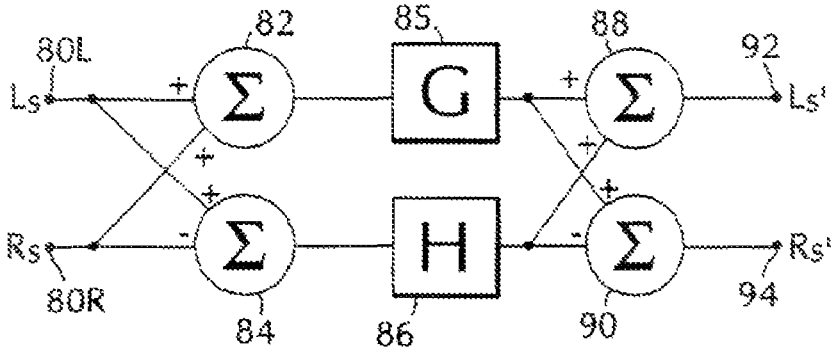
FIG. 5A is a diagrammatic view of a signal processing system according to an aspect of the invention.
Figure 5B:
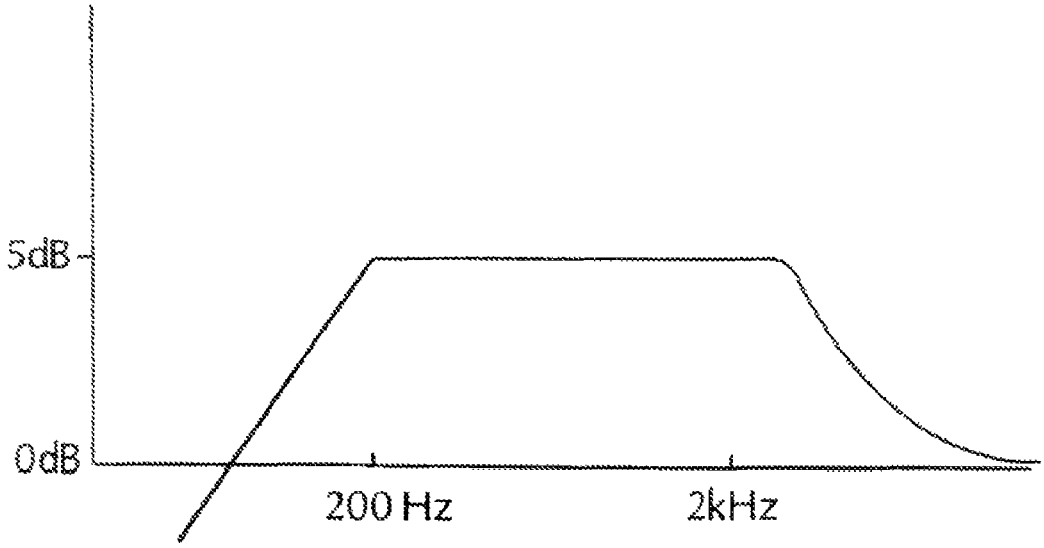
FIG. 5B is a graph of an equalization pattern according to an aspect of the invention.

In one embodiment of the invention, spatial enhancement signal processing is applied to the LS and RS channels before they are radiated by the transducers 12" and 14". Spatial enhancement signal processing has the effect of spreading the apparent separation between signal sources in a multi-channel speaker system. Referring now to FIG. 5A, there is shown one spatial enhancement signal processing system. Left surround input 80L is coupled to first and second summers 82 and 84. Right surround input 80R is coupled to first summer 82 and coupled subtractively to second summer 84. First summer 82 is coupled to first equalizer 35 which applies a first equalization pattern represented by transfer function G. Second summer 84 is coupled to second equalizer 86 which applies a second equalization pattern represented by transfer function H. First equalizer 85 is coupled to third summer 88 and fourth summer 90. Second equalizer 86 is coupled to third summer 92 and subtractively coupled to fourth summer 90. Third summer 88 is coupled to left surround output 92, and fourth summer 90 is coupled to right surround output 94. The result of the processing of the circuit of FIG. 5A is $$Ls'=C(Ls+Rs)+H(Ls-Rs)$$

$$Rs'=G(Ls+Rs)-H(Ls-Rs)$$

where transfer function G represents a standard equalization pattern, and transfer function H represents a cross equalization pattern shown in FIG. 5B and where Ls' is the spatially enhanced left surround signal and Rs' is the spatially enhanced right surround signal. If Ls=Rs, there is no cross equalization.

Figure 5C:
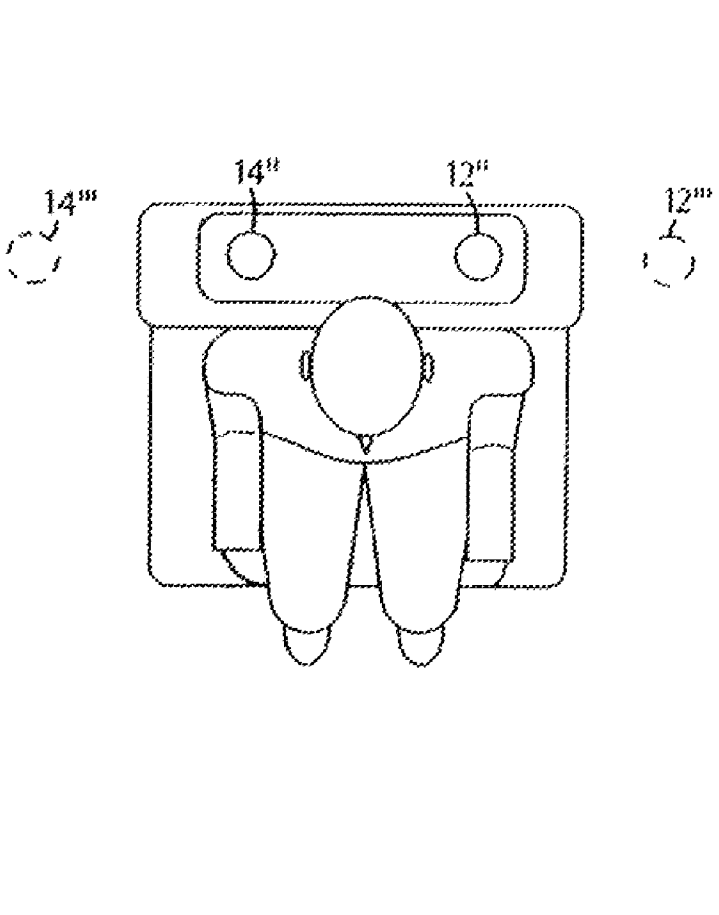
FIG. 5C is a diagrammatic view of the psychoacoustic effect of an aspect of the invention.
Figure 5C:
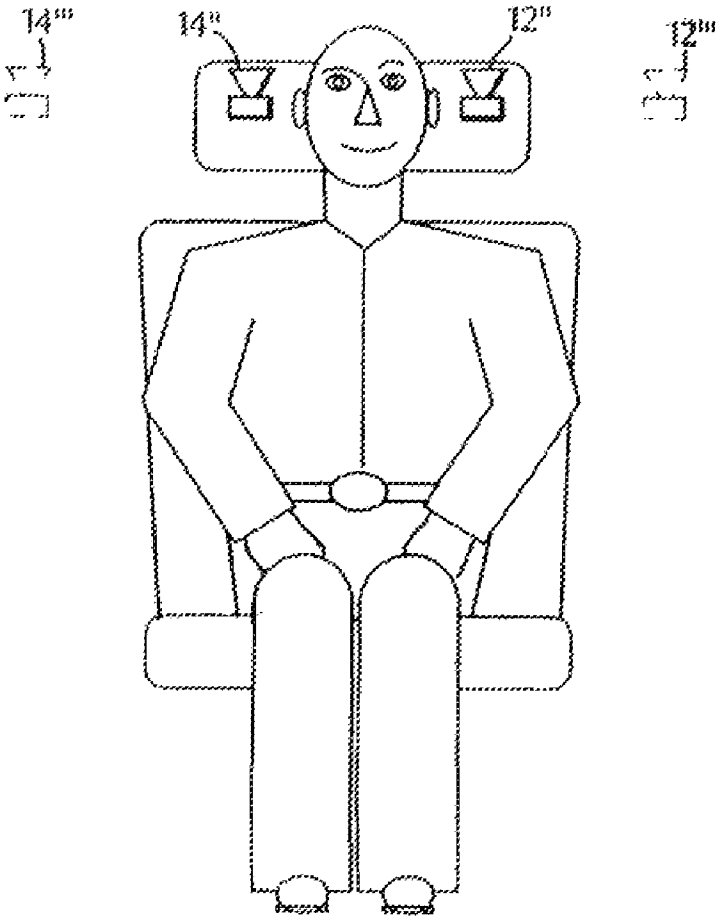

The effect of the spatial enhancement signal processing is illustrated in FIG. 5C. Transducers 12" and 14" in headrest 11 spatial enhancement signal processing applied to the signals causes the apparent positions 12''' and 14''' of transducers 12" and 14" to be shifted outward from the listener 18, so that the apparent separation between transducers 12" and 14" is increased, resulting in a soundstage that is wider and more pleasing than without the spatial enhancement signal processing.

Figure 6:
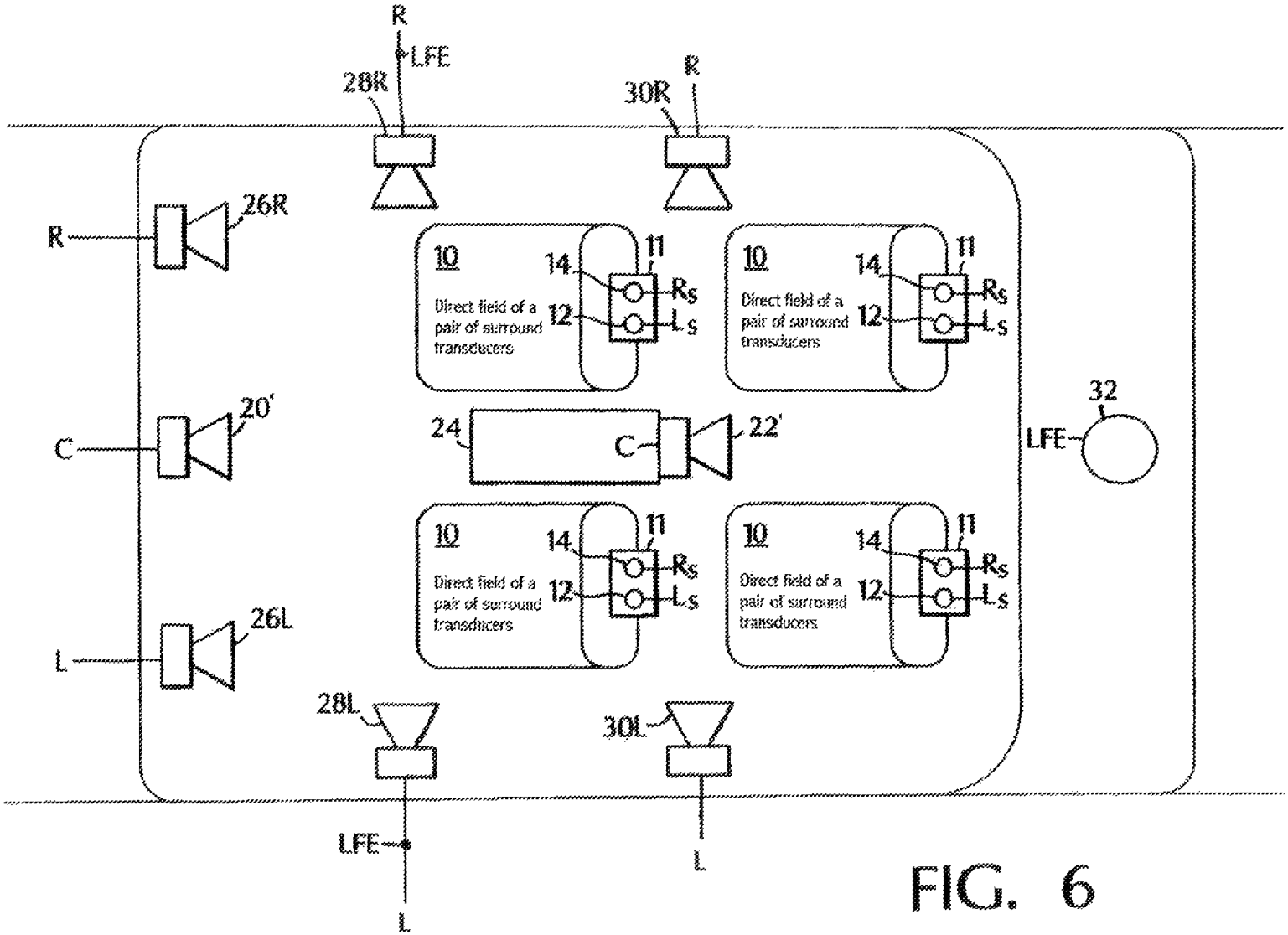
FIG. 6 is a diagrammatic view of an automobile audio system incorporating the invention.

Referring to FIG. 6, there is shown a top diagrammatic view of an automobile passenger compartment employing a 5.1 channel surround audio system and seating device and acoustic assemblies according to the invention. In the passenger compartment are four car seats 10 having headrests 11 in which transducers 12, 14 are mounted according to the invention. The channels are radiated by transducers positioned about the passenger compartment as follows. Center channel (C) is radiated by a first transducer 20 situated in the dashboard and by second transducer 22 positioned at the rear of a console 24 positioned between the front seats. Transducer 22 is oriented such that it radiates sound predominantly toward the rear of the passenger compartment. High frequency (above approximately 150 Hz) portions of the left (L) and right (R) channels are radiated by third and fourth transducers 26L and 26R, respectively, positioned on the left and on the right of the dashboard, respectively. Low frequency (below approximately 150 Hz) portion of the left and right channels are radiated by fifth and sixth transducers 28L and 28R, respectively, positioned in the left front door and right front door, respectively, forward of the front seats. Left and right channel spectral components above approximately 100 Hz are radiated by seventh and eighth transducers 30L and 30R, respectively, positioned in the left rear door and right rear door, respectively, forward of the rear seats. Bass, which may include the low frequency effects (LFE), channel is radiated by ninth transducer 32 positioned behind the two rear seats in the package shelf of the passenger compartment and by third and fourth transducers 26L and 26R. Left surround channel (LS) is radiated by four transducers 12 in the headrests of the four seats, and right surround channel (RS) is radiated by four transducers 14 in the headrests of the four seats.

Figure 7:
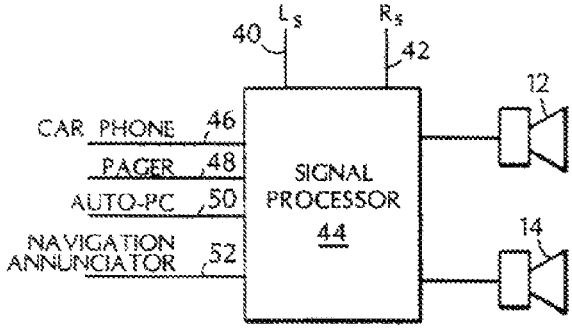
FIG. 7 is a block diagram illustrating the logical arrangement of an aspect of the invention.

Referring now to FIG. 7, there is shown a block diagram illustrating the logical arrangement of another feature of the invention. Left surround LS input terminal 40 and right surround RS input terminal 42 are coupled to signal processor 44 which is turn coupled to transducers 12 and 14. Other channels (L, R, C) are coupled to other transducers that are positioned about the automobile passenger compartment. An example of the placement of other transducers is shown in FIG. 5, but many other arrangements are possible. Also coupled to signal processor 44 are audio input terminals from auxiliary sources, such as car phone input terminal 46, pager input terminal 48, auto-pc input terminal 50, and navigation enunciator 52. If there are no signals on input terminals 46, 48, 50, 52, the signals from input terminals 40 and 42 are transmitted to transducers 12 and 14, and radiated as sound waves by transducers 12 and 14. If there is a signal on one of input terminals 46, 48, 50, or 52 from one of the auxiliary sources, the signal from the auxiliary source is transmitted, and the signals from the left surround input terminal 40 and right surround input terminal 42 are not transmitted so that the seat occupant hears the sound transmitted from the auxiliary source. Alternatively, the signal from the auxiliary source may be transmitted at a higher volume than the surround signals. In a variation of this embodiment, the circuit of FIG. 7 is applied only to the driver's seat, while the transducers in the remaining seats do not receive the signals from the auxiliary sources. FIG. 7 represents the logical arrangement of the elements and does not necessarily represent the physical arrangement of the elements. An analog implementation may have physical inputs corresponding to the logical input 40, 42, 46, 48, 50 and 52, while a digital implementation may have one or more physical inputs combining some or all of the logical inputs 40, 42, 46, 48, 50, and 52.

Figure 8:
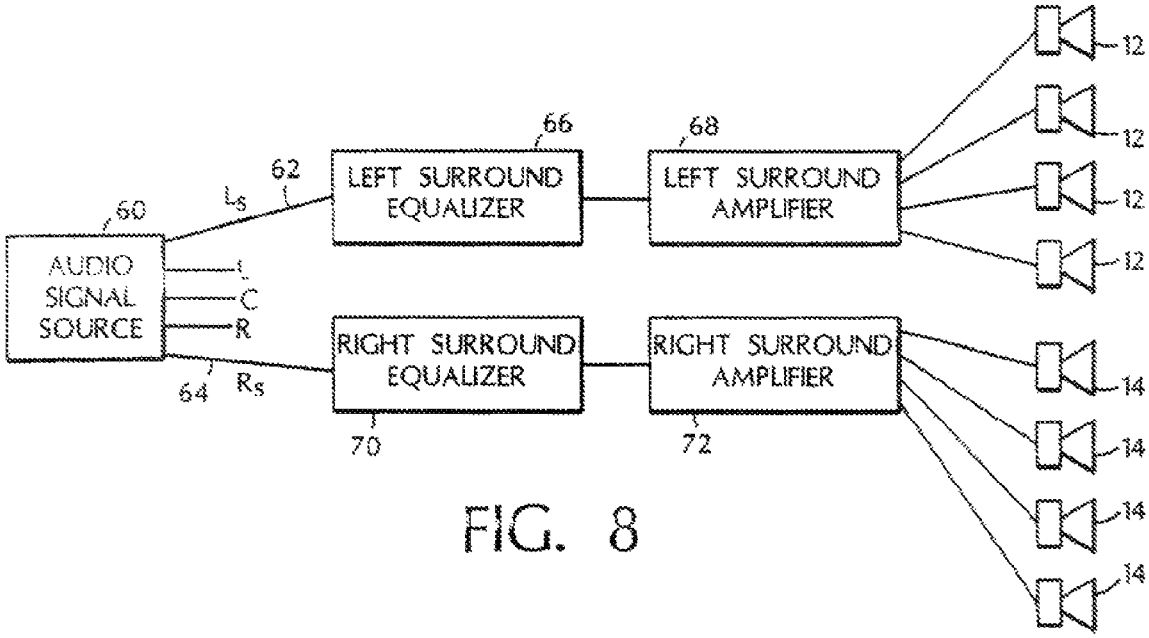
FIG. 8 is a block diagram illustrating the logical arrangement of an aspect of the invention.

Referring to FIG. 8 there is shown a logical arrangement of elements of an automobile audio system according to another aspect of the invention. Multichannel audio signal source 60 has a number of channel output terminals, including left surround channel output terminal 62 and right surround channel output terminal 64. Left surround channel output terminal 62 is coupled to left surround channel equalizer 66 and left surround channel amplifier 68. Left surround channel amplifier 68 is coupled to four left surround transducers 12, placed in automobile car seats similar to the four transducers 12' of FIG. 6. Similarly, right channel output terminal 64 is coupled to left surround channel equalizer 70 and right surround channel amplifier 72. Right surround channel amplifier 72 is coupled to four left surround transducers 14, placed in automobile car seats similar to the four transducers 14' of FIG. 6.

An audio system according to the embodiment of FIG. 8 is advantageous over conventional automobile audio systems in which the left and right surround channels either use a single pair of transducers to radiate each of the surround channels (which results in the equalization pattern and level being nonoptimized for all the individual listening locations) or to use several pairs of transducers and separately equalize and amplify each transducer (which requires additional components and is therefor more complicated and expensive). Referring again to FIGS. 4 and 6, in a sound system in accordance with this aspect of invention, each occupant of the automobile is in the direct field of a pair of surround transducers; that is, the occupant hears the surround channels primarily from the transducers mounted in the seat, and not from other transducers or from reflections from the automobile interior. Additionally, each occupant is in the same orientation relative to the near-field pair of transducers. Therefore, all the left surround transducers and all the right surround transducers can be equalized according to the same equalization pattern.

The embodiment of FIG. 8 can also be implemented in audio systems having a single or monophonic surround channels, either by mounting only one transducer in each seat, or by transmitting the single surround channel to both transducers, either in or out of phase.

Other embodiments are within the claims.

What is claimed is:

1. A vehicle sound system comprising, a vehicle having a console separating first and second front seats, a passenger compartment rear portion behind said first and second front seats, and an audio signal source, wherein said audio source is constructed and arranged with a center channel output for providing a center channel signal, the console having a rear panel facing said passenger compartment rear portion, and an electroacoustical transducer mounted on said rear panel and coupled to said audio source, said electroacoustical transducer being coupled to said center channel output for radiating said center channel signal.

2. The vehicle sound system of claim 1, further comprising an additional electroacoustical transducer coupled to said audio source.

3. The vehicle sound system of claim 2, wherein said audio source is capable of outputting a surround channel signal to said additional transducer.

4. The vehicle sound system of claim 2, further comprising third and fourth rear seats located in said passenger compartment rear portion, said additional transducer being mounted in one of said first through fourth seats.

5. The vehicle sound system of claim 4, wherein said audio source is capable of outputting a surround channel signal to said additional transducer.

6. The vehicle sound system of claim 4, wherein said additional transducer is mounted in one of said rear seats.

7. The vehicle sound system of claim 6, wherein said audio source is capable of outputting a surround channel signal to said additional transducer.

8. The vehicle sound system of claim 6, wherein said additional transducer is mounted in a seat back of one of said rear seats.

9. The vehicle sound system of claim 8, wherein said audio source is capable of outputting a surround channel signal to said additional transducer.

10. The vehicle sound system of claim 6, wherein said additional transducer is mounted in a headrest of a seat back of one of said rear seats.

11. The vehicle sound system of claim 10, wherein said audio source is capable of outputting a surround channel signal to said additional transducer.

* * * * *